US011060825B2

(12) United States Patent
Gattoni et al.

(10) Patent No.: US 11,060,825 B2
(45) Date of Patent: Jul. 13, 2021

(54) FOG-GENERATING DEVICE

(71) Applicant: UR FOG S.R.L., Turin (IT)

(72) Inventors: Luca Gattoni, Turin (IT); Giovanni Balestrini, Turin (IT)

(73) Assignee: UR FOG S.R.L., Turin (IT)

( * ) Notice: Subject to any disclaimer, the term of this patent is extended or adjusted under 35 U.S.C. 154(b) by 16 days.

(21) Appl. No.: 16/647,680

(22) PCT Filed: Aug. 13, 2018

(86) PCT No.: PCT/IT2018/000106
§ 371 (c)(1),
(2) Date: Mar. 16, 2020

(87) PCT Pub. No.: WO2019/058400
PCT Pub. Date: Mar. 28, 2019

(65) Prior Publication Data

US 2020/0217624 A1 Jul. 9, 2020

(30) Foreign Application Priority Data

Sep. 21, 2017 (IT) ..... 102017000105423

(51) Int. Cl.
*F41H 9/08* (2006.01)
*G08B 15/02* (2006.01)

(52) U.S. Cl.
CPC ..... *F41H 9/08* (2013.01); *G08B 15/02* (2013.01)

(58) Field of Classification Search
CPC . F41H 9/06; F41H 9/08; F16K 31/025; F16K 3/04; G08B 15/02; C06D 3/00
See application file for complete search history.

(56) References Cited

U.S. PATENT DOCUMENTS 7,325,495 B1 * 2/2008 Giandomenico ..... F41H 9/10 102/368
7,762,585 B2 * 7/2010 Patterson ..... B60R 21/26 280/740
7,814,838 B2 * 10/2010 McCormick ..... C06D 5/06 102/530

(Continued)

FOREIGN PATENT DOCUMENTS

EP 2719432 A1 4/2014
EP 2860486 B1 12/2015

(Continued)

OTHER PUBLICATIONS

EPO Communication under Rule 161 &162 EPC in EP18783588.9 (European phase of PCT/IT2018/000106), dated Apr. 29, 2020.

(Continued)

*Primary Examiner* — An T Nguyen
(74) *Attorney, Agent, or Firm* — Law Offices of Nisan Steinberg

(57) ABSTRACT

A fog-generating device (1) is described, comprising a heat accumulator to store thermal energy and release it to a fog-generating fluid, to produce steam, and a thermal mass composed of a plurality of small metal plates (11, 12, 13, 14, 15, 16, 17, 18, 19, 20) housed, inside a container (2), in order to locate a path of the fog-generating fluid adapted to lick the surface of the small metal plates (11, 12, 13, 14, 15, 16, 17, 18, 19, 20), generating a vaporization of the fog-generating fluid.

8 Claims, 5 Drawing Sheets

(56) References Cited

U.S. PATENT DOCUMENTS

Figure 1:
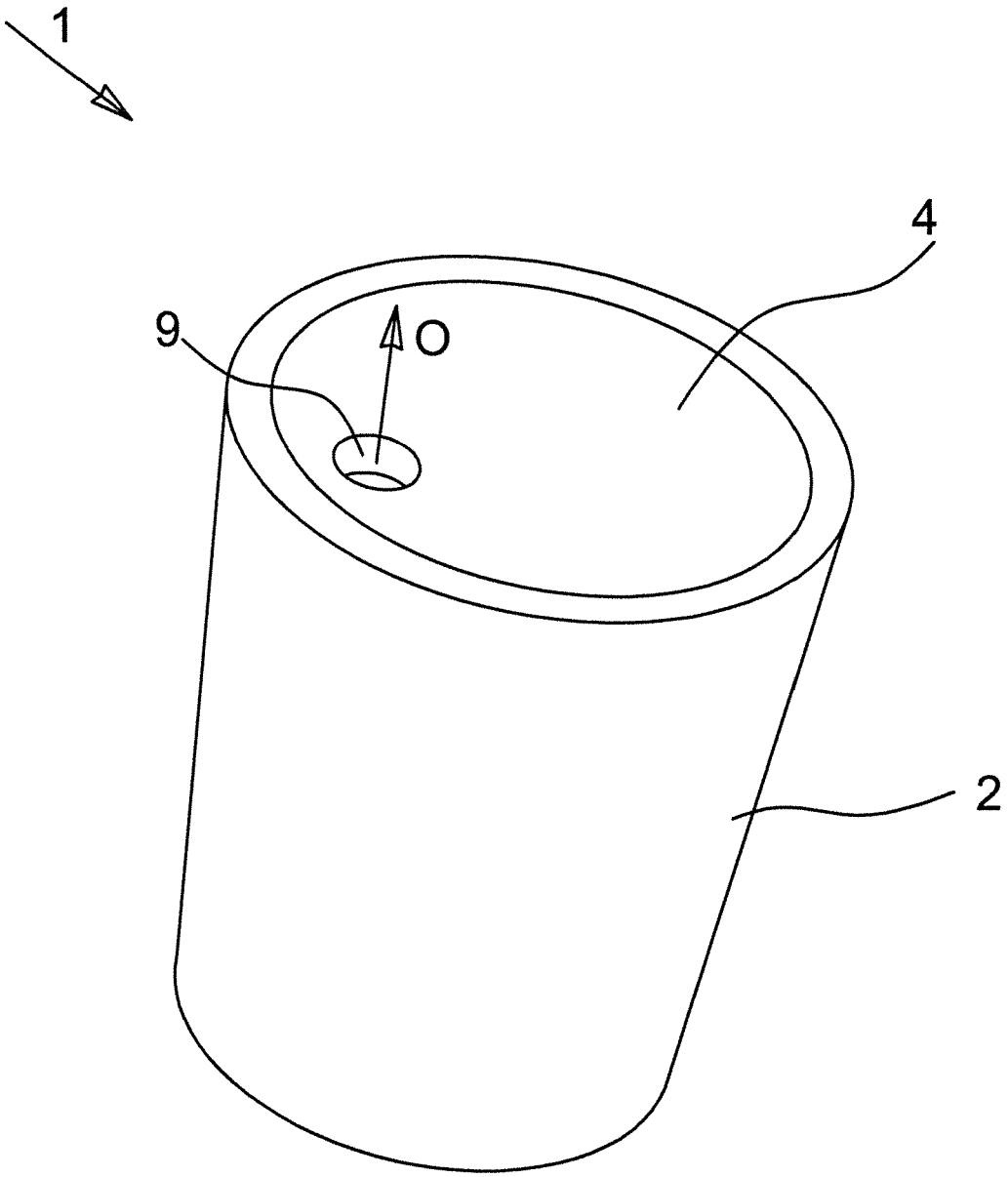

| | | | | |
|---|---|---|---|---|
| 10,107,598 | B2 | 10/2018 | Vandoninck | |
| 10,189,753 | B2 | 1/2019 | Vandoninck | |
| 2014/0191057 | A1* | 7/2014 | Eames | B01F 5/0451 239/8 |
| 2015/0027334 | A1* | 1/2015 | Kireev | F42B 12/40 102/439 |
| 2015/0321970 | A1* | 11/2015 | Vandoninck | B05B 9/002 102/530 |
| 2017/0176150 | A1 | 6/2017 | Vandoninck | |
| 2018/0259301 | A1* | 9/2018 | Mimura | F42B 12/48 |
| 2020/0217624 | A1* | 7/2020 | Gattoni | F41H 9/06 |

FOREIGN PATENT DOCUMENTS

| | | | |
|---|---|---|---|
| EP | 2955474 | A1 | 12/2015 |
| EP | 2938959 | B1 | 3/2017 |
| WO | 2014102365 | A1 | 7/2014 |
| WO | 2015140762 | A2 | 9/2015 |

OTHER PUBLICATIONS

International Preliminary Report on Patentability (IPRP) in PCT/IT2018/000106, dated Mar. 24, 2020.
Written Opinion and International Search Report (ISR) of ISA/EP in PCT/IT2018/000106, dated Jan. 7, 2019.

* cited by examiner

FOG-GENERATING DEVICE

CROSS-REFERENCE TO RELATED APPLICATIONS

This is a U.S. national phase application under 35 U.S.C. § 371 of Patent Cooperation Treaty Application No. PCT/IT2018/000106, filed Aug. 13, 2018, which claims priority from Italian Patent Application Serial No. 102017000105423, filed on Sep. 21, 2017, and which incorporates by reference those PCT and Italian applications in their entireties.

The present invention refers to a fog-generating device, adapted to produce very thick fog, to increase the safety level of an alarm system.

Fog-generating devices are adapted to produce a very thick fog, which completely prevents the vision. To obtain this result, it is necessary that a fog-generating fluid is quickly evaporated and afterwards condensed into micro-droplets. The size of these droplets is rather big for them not to be crossed by light without interfering therewith, and consequently they cause a diffusion phenomenon (scattering) which precludes visibility.

These devices are therefore adapted to prevent a theft or a robbery, since they quickly produce an amount of fog which, for a long time, completely prevents the vision, so that a thief or robber, getting confused, often refrains from continuing.

To minimize the chance that a thief completes his theft or causes damages, it is necessary that the environment saturation occurs in the shortest possible time. To obtain this result, it is necessary to give the fluid a high power, at least equal to the specific evaporation heat for the number of units of required liquid mass.

The necessary power to have adequate effects ranges from few kW, for machines with scarce performances, to tens or even hundreds of kW for machines at top level. It is clear that such powers cannot be delivered by meters of the supplier of electric energy, but extracted from an "energy warehouse" placed on site. The sizes of this warehouse in terms of kWh give the maximum amount of fog-generating fluid capable of evaporating from the apparatus.

Such energy is stored in thermal form in the sensitive heat of a metallic mass. This mass is preferably heated by an electric resistance for a time long enough not to require high powers, the accumulated heat being quickly given when it is crossed by a fog-generating fluid which moves along the serpentine and/or meatuses obtained therein.

The construction of these internal circuits is critical for the correct extraction of energy from the accumulator, this extraction having to be performed in very short times.

Currently, the circuits are made with deep holes connected in the high and low parts of the accumulator through transverse holes and welding. This work is very long and costly, both in terms of execution time and in terms of tools and waste of material. Moreover, the space of the hole is subtracted from the thermal mass of the accumulator.

Upon increasing the required power, the number of holes must increase in order to increase the exchange surface, and a technical/economic limit is soon reached for the construction.

Currently used devices are technical and economic compromises, which makes it difficult and not convenient the completion of the application of such technology. Moreover, the use of materials with high thermal conductivity, such as aluminum, if on one hand enable extracting heat, on the other hand makes the fluid too quickly evaporate, creating a gas cushion which insulates the drop of fluid from a thermal contact. This is known as "Leidenfrost effect". Vice versa, if the metal has a low thermal conductivity, the temperature of the surface, in contact with the fluid, quickly decreases. The Leidenfrost effect is cancelled, but the chance of quickly extracting head from the metallic part far from the channel, is reduced.

Object of the present invention is solving the above prior art problems, by providing a new solution which overcomes the above limitations.

The above and other objects and advantages of the invention, as will appear from the following description, are obtained with a device as claimed in claim 1.

Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and part with equivalent functionality) can be made to what is described, without departing from the scope of the invention as appears from the enclosed claims.

Figure 2:
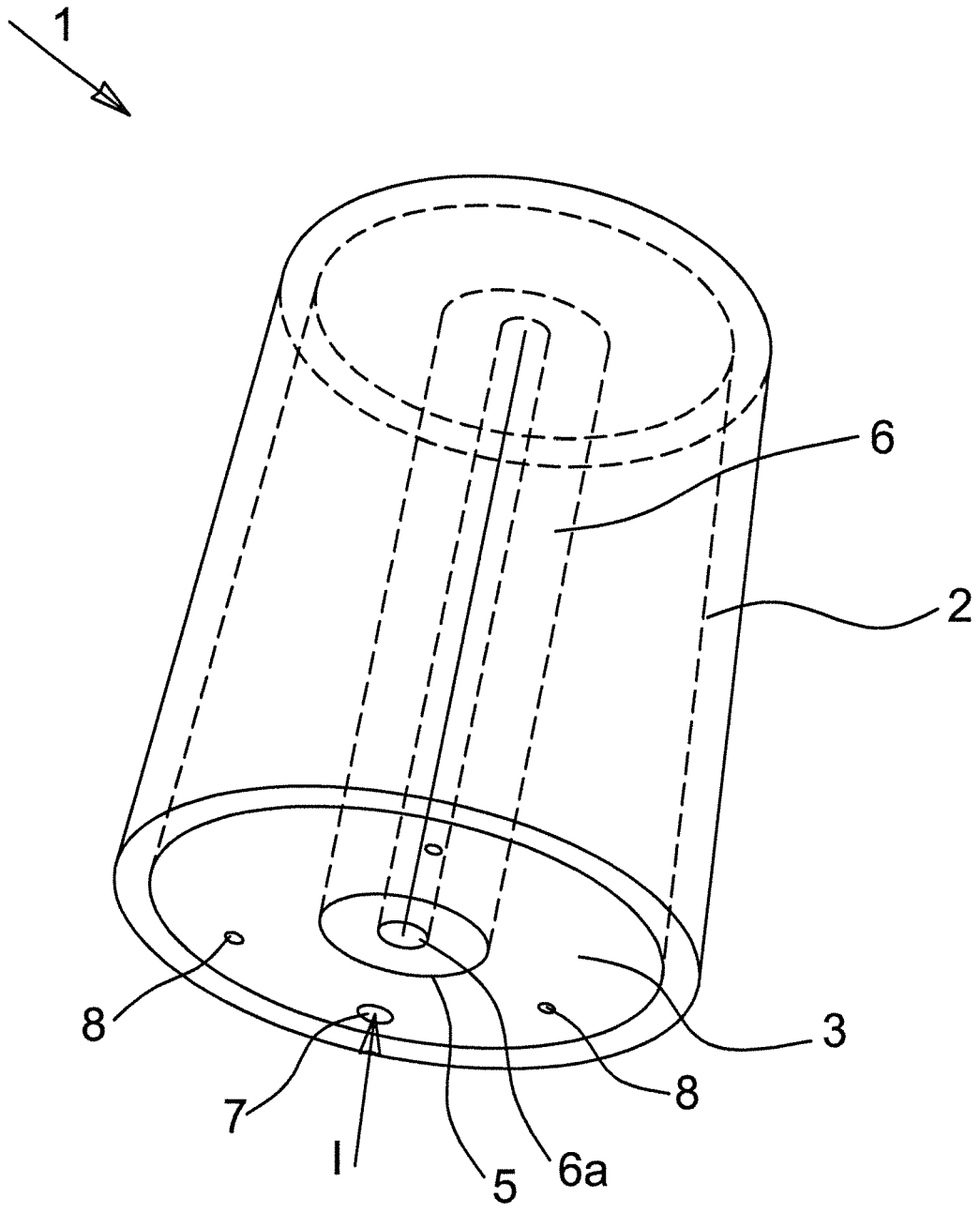
Figure 3:
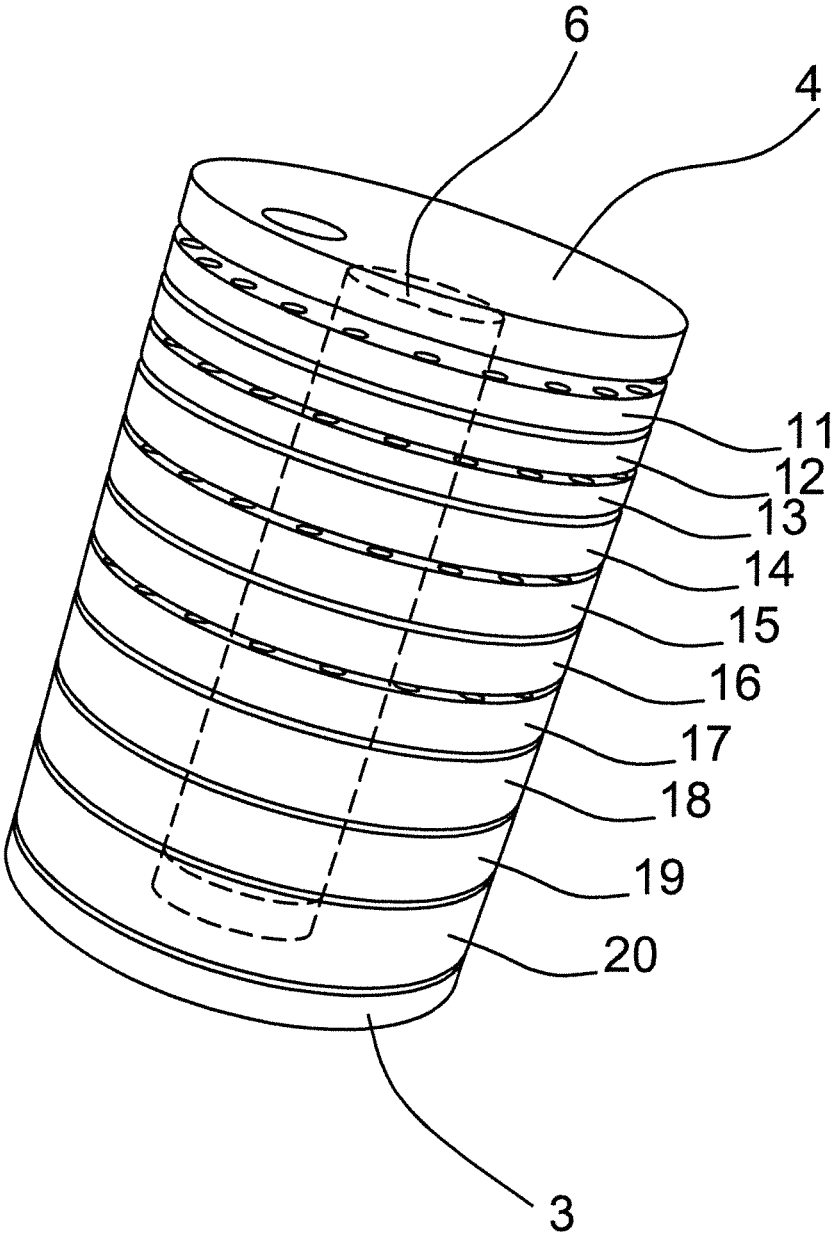
Figure 4:
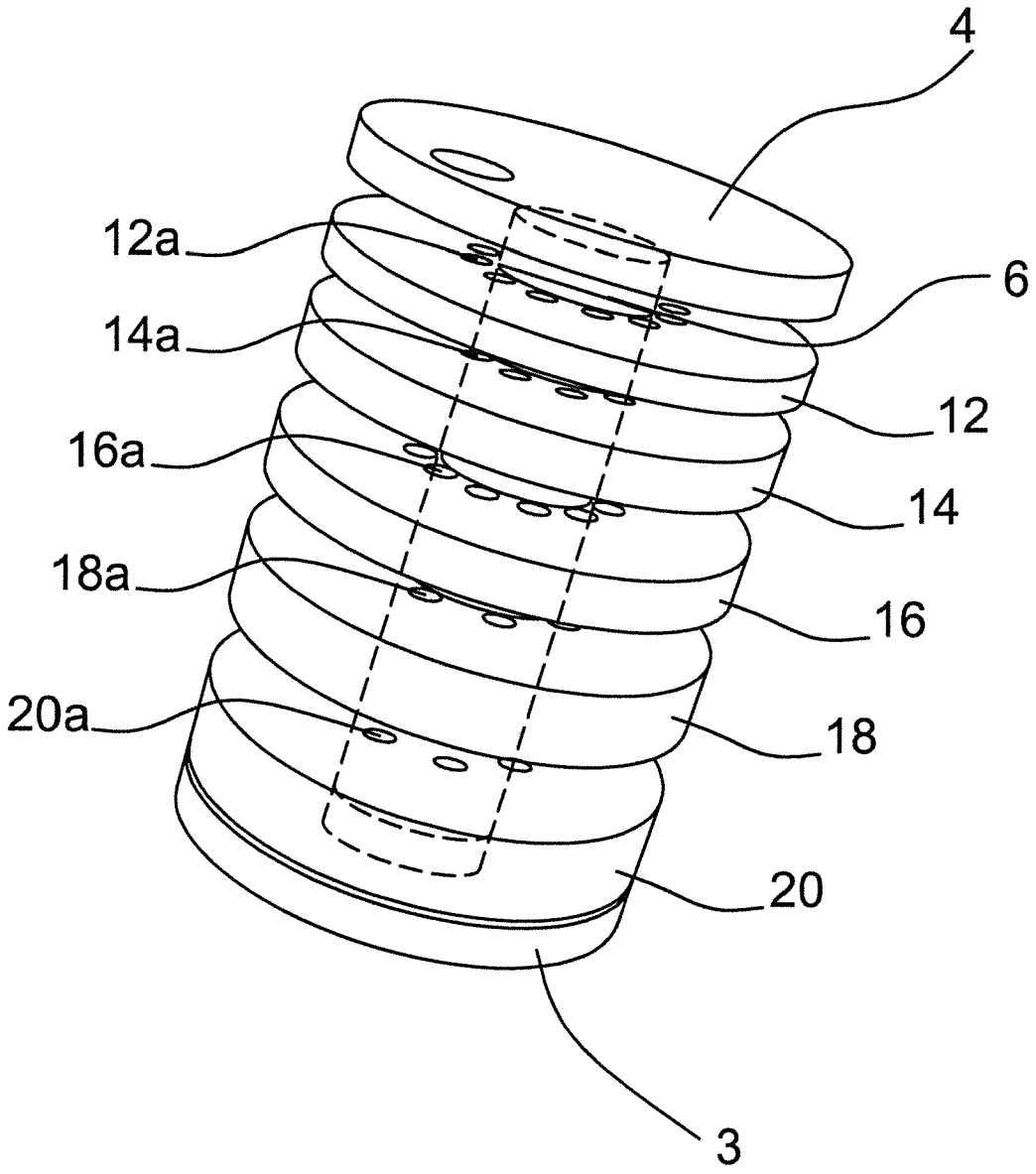
Figure 5:
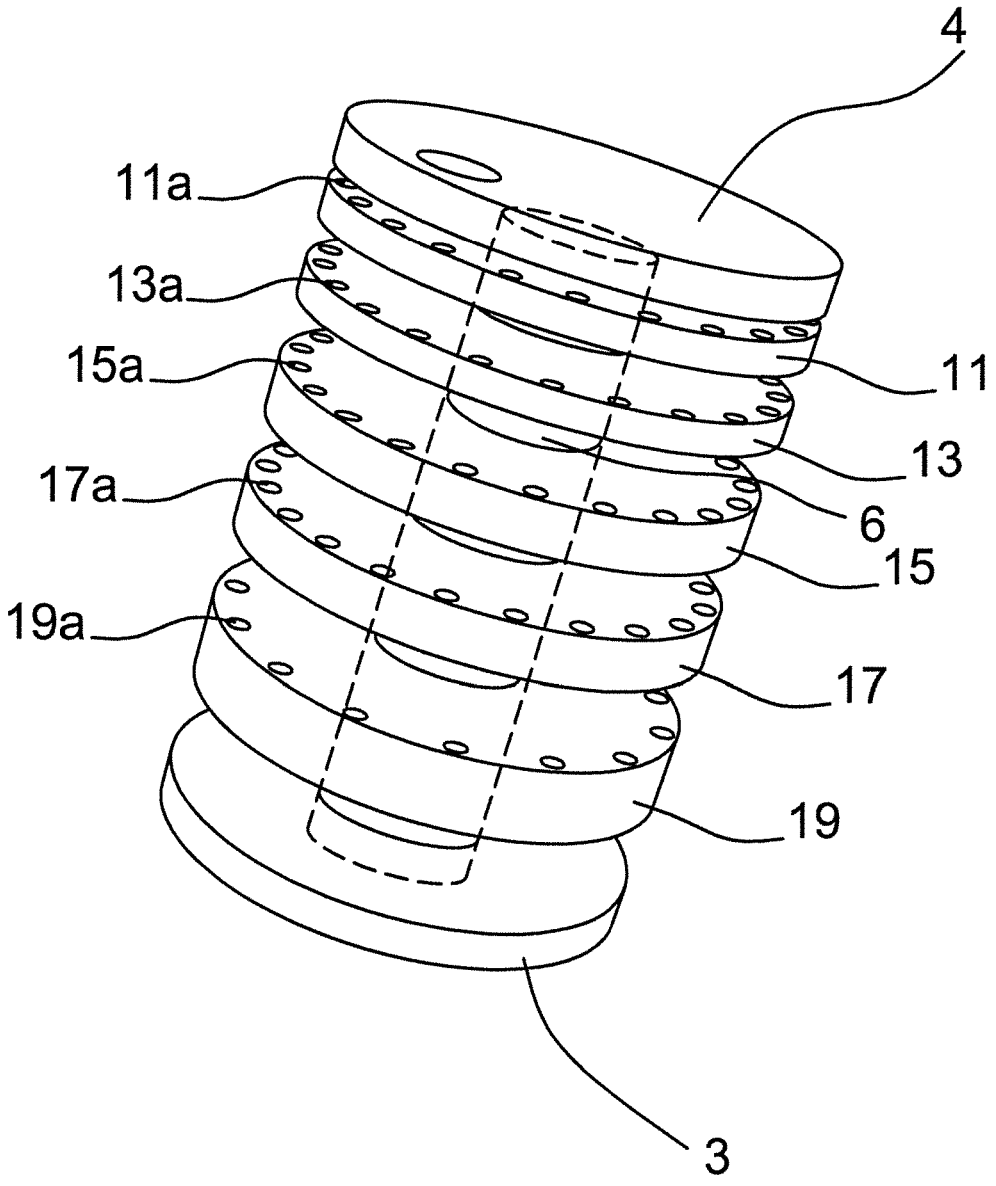

The present invention will be better described by some preferred embodiments thereof, provided as a non-limiting example, with reference to the enclosed drawings, in which:

FIGS. 1 and 2 show the fog-generating device of the invention, respectively from its upper part and its lower part; and FIGS. 3, 4 and 5 show the internal elements of the fog-generating device of the invention.

With reference to the Figures, the fog-generating device 1 of the invention is adapted to produce a thick fog to increase the safety level of an alarm system, and is of the type which comprises a heat accumulator adapted to store thermal energy and to release it to a fog-generating fluid, to produce steam.

The fog-generating device 1 comprises:

- first heating means adapted to produce the thermal energy;
- second means adapted to put the fog-generating fluid in contact with the heat accumulator;
- third means adapted to support a quick thermal exchange between the heat accumulator and the fog-generating fluid, the thermal exchange being quick enough to support a production of steam; and
- fourth means adapted to expel the steam produced following the vaporization of the fog-generating fluid.

The third means, adapted to support a quick thermal exchange between the heat accumulator and the fog-generating fluid, comprise a thermal mass composed of a plurality of small metal plates 11, 12, 13, 14, 15, 16, 17, 18, 19, 20 housed, inside a container 2, in order to locate a path of the fog-generating fluid adapted to lick the surface of the small metal plates 11, 12, 13, 14, 15, 16, 17, 18, 19, 20, generating a vaporization of the fog-generating fluid, the small plates 11, 12, 13, 14, 15, 16, 17, 18, 19, 20 being composed of first small plates 11, 13, 15, 17, 19 and second small plates 12, 14, 16, 18, 20 and being assembled in order to locate meatuses adapted to allow the flow of the fog-generating fluid.

Means are provided which are adapted to hydraulically mutually connect the meatuses, the hydraulic connection means, adapted to hydraulically mutually connect the meatuses, comprising a plurality of first pouring holes or areas 11*a*, 13*a*, 15*a*, 17*a*, 19*a* and a plurality of second pouring holes or areas 12*a*, 14*a*, 16*a*, 18*a*, 20*a* obtained on the small plates 11, 12, 13, 14, 15, 16, 17, 18, 19, 20.

The first pouring holes or areas 11*a*, 13*a*, 15*a*, 17*a*, 19*a* are made next to the external edge of the first small plates 11, 13, 15, 17, 19, while the second pouring holes or areas 12*a*, 14*a*, 16*a*, 18*a*, 20*a* are arranged inside the second small plates 12, 14, 16, 18, 20 next to the core of the fog-generating device 1, the first small plates 11, 13, 15, 17, 19 being alternated with the second small plates 12, 14, 16, 18, 20 inside the container 2.

With reference to FIGS. 1 and 2, 1 designates the fog-generating device with disks of the invention. The fog-generating device 1 is a boiler comprising a container 2, for example with a cylindrical shape, closed in its lower part by a first small plate 3 and in its upper part by a second small plate 4.

A central hole 5 is obtained on the first small lower closing plate 3, in which a metallic core 6 is inserted, which extends till it touches the second small upper closing plate 4 or is inserted inside it. The metallic core 6, in turn, has a longitudinal hole 6*a* to insert one or more electric resistances for heating the fog-generating device 1.

On the first small lower closing plate 3 there is also a hole 7 for entering the fog-generating liquid, as shown by arrow "I". on the small lower closing plate 3 there are possibly also threaded holes 8 for supporting feet, should the fog-generating device 1 be rested on a sheet of a container or a horizontal plane.

On the second small upper closing plate 4 a hole 9 is obtained, through which the vaporized the fog-generating fluid goes out, as pointed out by arrow "O".

Inside the container 2 a plurality of small metal plates 11, 12, 13, 14, 15, 16, 17, 18, 19, 20 are inserted (FIG. 3), included between the small lower 3 and upper 4 closing plates, the small plates being mutually separated, in order to locate meatuses whose thickness is a few millimeters, these meatuses being mutually communicated by a plurality of pouring holes 11*a*, 12*a*, 13*a*, 14*a*, 15*a*, 16*a*, 17*a*, 18*a*, 19*a*, 20*a* obtained on the small plates 11, 12, 13, 14, 15, 16, 17, 18, 19, 20.

According to a preferred embodiment, the small plates 11, 12, 13, 14, 15, 16, 17, 18, 19, 20 are axially drilled in order to be inserted on the metallic core 6.

FIG. 5 shows first small plates designated by odd numbers 11, 13, 15, 17, 19, while FIG. 4 shows second small plates designated with even numbers 12, 14, 16, 18, 20.

The first small plates, designated with odd numbers 11, 13, 15, 17, 19, alternate with the second small plates, designated with even numbers 12, 14, 16, 18, 20. On the first small plates 11, 13, 15, 17, 19 the pouring holes 11*a*, 13*a*, 15*a*, 17*a*, 19*a* are made next to the external edge of the small plates themselves, while on the second small plates 12, 14, 16, 18, 20 the pouring holes 12*a*, 14*a*, 16*a*, 18*a*, 20*a* are made in the internal area, in particular next to the central core 6.

According to a preferred embodiment, layers of small plates with different thickness and of the same or different materials are alternated (as a non-limiting example, steel and aluminum), the choice being made depending on requested performances. Solution which use aluminum in combination with steel allow improving the thermal capacity of the heat exchanged with the same weight, and avoiding, or at least minimizing, the Leidenfrost effect, which occurs in boilers only made of aluminum.

In particular, the thickness of the various small plates will be related with the thickness of the corresponding meatuses, in order to optimize the amount of heat and the thermal exchange step by step in the process, as will be better specified below.

Once the pack of small plates has reached the operating temperature, the fog-generating fluid is inserted through the hole 7 present on the small lower closing plate 3, and will therefore get in contact with the various layers composed of small plates 11, 12, 13, 14, 15, 16, 17, 18, 19, 20. The particular position of the pouring holes 11*a*, 12*a*, 13*a*, 14*a*, 15*a*, 16*a*, 17*a*, 18*a*, 19*a*, 20*a* compels the fog-generating fluid to lick the whole exchange surface, optimally subtracting heat.

The exchange surfaces, the thermal capacities of each small plate licked by the fog-generating fluid and the thickness of the meatuses will have to be chosen in order to optimize the amount of heat and the thermal exchange step by step in the process.

In the first section of the path, the sensible fluid temperature will be increases, in the second section the evaporation will occur and in the third section the steam overheating will occur.

Each step is associated with an optimum combination of accumulated energy and exchange surface, which can be easily made with the proposed technique.

According to the described embodiment, the container 2 is cylindrical. In this case, the small plates 11, 12, 13, 14, 15, 16, 17, 18, 19, 20 have a circular shape; however, the container 2 can also have a rectangular or polygonal shape: in such case, the small plates contained therein will have a corresponding shape.

Also the pouring holes 11*a*, 12*a*, 13*a*, 14*a*, 15*a*, 16*a*, 17*a*, 18*a*, 19*a*, 20*a* can have a shape different from the circular one, or can be replaced by continuous areas included between the external edge of the small plates and the external container 2, combined with other internal passage areas included between the internal edge of the small plates and the metallic core 6.

The metallic core 6 is an integral part of the machine sizing. Though scarcely contributing to the thermal exchange with the fog-generating fluid, it determines the transfer speed of heat between the heating element and the small accumulating plates 11, 12, 13, 14, 15, 16, 17, 18, 19, 20 and further acts as separating element (buffer) due to which the heating element is not subjected to sudden temperature variations during the vaporization of the fluid.

The thereby constructed boiler 1 allows the passage of the fog-generating fluid on the whole surface of the small plates 11, 12, 13, 14, 15, 16, 17, 18, 19, 20, optimizing the exchange surface and allowing to make also big-sized heat exchangers, because it width and thickness of the small plates can be easily dimensioned, allowing the use of all energy contained in the exchanger.

Some preferred embodiments of the invention have been described, but obviously they are subjected to further modifications and variations within the same inventive idea. In particular, it will be immediately clear for the skilled people in the art that there are numerous variations and modifications, functionally equivalent to the previous ones, which fall within the scope of the invention as pointed out by the enclosed claims, such as for example the embodiment without a container with overlapped small plates.

The invention claimed is:

1. A fog-generating device, adapted to produce a thick fog to increase the safety level of an alarm system, of the type which comprises a heat accumulator adapted to store thermal energy and to release it to a fog-generating fluid, to produce steam, said fog-generating device, comprising:

first heating means adapted to produce said thermal energy;

second means adapted to put said fog-generating fluid in contact with said heat accumulator;

third means adapted to support a quick thermal exchange between said heat accumulator and said fog-generating fluid, said thermal exchange being quick enough to support a production of steam; and fourth means adapted to expel the steam produced following a vaporization of said fog-generating fluid;

characterized in that said third means, adapted to support a quick thermal exchange between said heat accumulator and said fog-generating fluid, comprise a thermal mass composed of a plurality of small metal plates housed, inside a container, in order to locate a path of the fog-generating fluid adapted to contact the surface of said small metal plates, generating a vaporization of said fog-generating fluid, said small metal plates being composed of first small plates and second small plates and being assembled in order to locate meatuses adapted to allow a flow of the fog-generating fluid, means being provided which are adapted to hydraulically mutually connect said meatuses, said hydraulic connection means, adapted to hydraulically mutually connect said meatuses comprising a plurality of first pouring holes or areas and a plurality of second pouring holes or areas made on said small metal plates, said first pouring holes or areas being made next to the external edge of said first small plates, while said second pouring holes or areas are arranged inside said second small plates next to a metallic core of said fog-generating device, said first small plates being alternated with said second small plates inside said container.

2. The fog-generating device according to claim 1, characterized in that said small plates are axially drilled in order to be inserted on the metallic core.

3. The fog-generating device according to claim 1, characterized in that said hydraulic connection means comprise continuous areas included between an external edge of said first small plates and the external container, combined with other internal passage areas included between the internal edge of said second small plates and said metallic core.

4. The fog-generating device according to claim 1, characterized in that said first heating means comprise one or more electric resistances inserted in a longitudinal hole made in said metallic core.

5. The fog-generating device according to claim 1, characterized in that said second means, adapted to put said fog-generating fluid in contact with said heat accumulator, comprise a entry hole made in a small lower closing plate.

6. The fog-generating device according to claim 1, characterized in that said fourth means, adapted to expel the steam produced by said fog-generating fluid, comprise an exit hole, made on a small upper closing plate.

7. The fog-generating device according to claim 1, characterized in that said small metal plates are made of aluminum.

8. The fog-generating device according to claim 1, characterized in that said small metal plates are partially made of aluminum and partially made of steel.

* * * * *